US008588628B2

(12) United States Patent
Ogawa et al.

(10) Patent No.: US 8,588,628 B2
(45) **Date of Patent: *Nov. 19, 2013**

(54) FIXING DEVICE AND IMAGE FORMING APPARATUS

(75) Inventors: Tadashi Ogawa, Tokyo (JP); Masanao Ehara, Kanagawa (JP); Satoshi Ueno, Tokyo (JP); Hiroshi Seo, Kanagawa (JP); Takamasa Hase, Kanagawa (JP); Shuutaroh Yuasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 329 days.

This patent is subject to a terminal disclaimer.

(21) Appl. No.: 13/064,201

(22) Filed: Mar. 10, 2011

(65) Prior Publication Data

US 2011/0229162 A1 Sep. 22, 2011

(30) Foreign Application Priority Data

Mar. 17, 2010 (JP) ..... 2010-060647

(51) Int. Cl.
*G03G 15/20* (2006.01)

(52) U.S. Cl.
USPC ..... 399/33; 399/67; 399/69; 399/328

(58) Field of Classification Search
USPC ..... 399/33, 67, 69, 328
See application file for complete search history.

(56) References Cited

U.S. PATENT DOCUMENTS

| | | | |
|---|---|---|---|
| 7,266,336 | B2 | 9/2007 | Ueno et al. |
| 7,450,872 | B2 | 11/2008 | Ueno et al. |
| 7,491,917 | B2 | 2/2009 | Ueno |
| 7,715,774 | B2 | 5/2010 | Ueno |
| 7,778,581 | B2 | 8/2010 | Seo et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,817,952 | B2 | 10/2010 | Seo et al. |
| 7,885,590 | B2 | 2/2011 | Seo et al. |
| 2006/0029411 | A1 | 2/2006 | Ishii et al. |
| 2007/0014600 | A1 | 1/2007 | Ishii et al. |
| 2007/0280754 | A1 | 12/2007 | Ogawa et al. |

(Continued)

FOREIGN PATENT DOCUMENTS

| | | | |
|---|---|---|---|
| JP | 2002287542 | A | 10/2002 |
| JP | 2007328159 | A | 12/2007 |
| JP | 2009-025571 | | 2/2009 |
| JP | 2009092743 | A | 4/2009 |

OTHER PUBLICATIONS

U.S. Notice of Allowance dated Mar. 18, 2013 issued in co-pending U.S. Appl. No. 13/064,137.

*Primary Examiner* — Ryan Walsh
(74) *Attorney, Agent, or Firm* — Harness, Dickey & Pierce P.L.C.

(57) ABSTRACT

A fixing device includes a fixing member, an induction heating unit, a pressing member, and a damage detection unit. The fixing member heats a toner image on a recording medium to fix the toner image onto the recording medium. The induction heating unit heats the fixing member by electromagnetic induction. The pressing member presses the fixing member to form a fixing nip portion. The fixing member includes a heat insulating elastic layer and a sleeve layer. The sleeve layer is located outside the heat insulating elastic layer and is provided with an outer conductive layer that generates heat from a magnetic flux generated by the induction heating unit. The damage detection unit is connected to the outer, conductive layer.

13 Claims, 3 Drawing Sheets

(56) References Cited

U.S. PATENT DOCUMENTS

| | | | | |
|---|---|---|---|---|
| 2008/0025773 | A1 | 1/2008 | Ito et al. | |
| 2008/0063443 | A1 | 3/2008 | Yoshinaga et al. | |
| 2009/0060550 | A1 | 3/2009 | Seo | |
| 2009/0148205 | A1 | 6/2009 | Seo et al. | |
| 2009/0238593 | A1* | 9/2009 | Kinouchi et al. | 399/67 |
| 2009/0245897 | A1 | 10/2009 | Seo et al. | |
| 2009/0297197 | A1 | 12/2009 | Hase | |
| 2010/0061753 | A1 | 3/2010 | Hase | |
| 2011/0058863 | A1 | 3/2011 | Shinshi et al. | |
| 2011/0064450 | A1 | 3/2011 | Ishii et al. | |
| 2011/0064502 | A1 | 3/2011 | Hase et al. | |
| 2011/0176822 | A1 | 7/2011 | Ishii et al. | |
| 2011/0222876 | A1 | 9/2011 | Yuasa et al. | |
| 2012/0301162 | A1 | 11/2012 | Sasaki et al. | |

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2010-060647 filed in Japan on Mar. 17, 2010.

BACKGROUND OF THE INVENTION

1. Field of the Invention

The present invention relates to a fixing device configured to be incorporated in an image forming apparatus and the image forming apparatus.

2. Description of the Related Art

There have been known fixing devices of electromagnetic induction heating type used in an image forming apparatus such as copiers, printers, and facsimile machines. For example, Japanese Patent Application Laid-open No. 2007-328159 discloses an electromagnetic induction heating fixing device. The fixing device of this type is mainly includes a fixing member such as a fixing roller and a fixing belt, a pressing member that is in pressure contact with the fixing member to form a nip portion, and an induction heating unit that faces the outer circumferential surface of the fixing member to heat the fixing member by electromagnetic induction. The induction heating unit includes an excitation coil, a core that covers the excitation coil, a coil guide that holds the excitation coil and faces the fixing member, and the like.

Energizing the excitation coil of the induction heating unit causes a magnetic flux to be formed around the heat generating layer of the fixing member or the heat generating layer of a heating member abutting against the fixing member. The heat generating layer is thus heated by electromagnetic induction, resulting in the fixing member being directly or indirectly heated. Accordingly, toner on a recording medium in contact with the fixing member at the fixing nip portion is heated and melted, and thereby fixed on the recording medium.

The heat generating layer is required to be thin because it also forms the fixing nip portion. Thus, the heat generating layer as well as the sleeve layer is susceptible to damage when the heat generating layer is defective due to scratches on the material or malfunctions such as runaway due to overheating. Damage to the sleeve layer causes a broken piece of the thin metal layer such as the heat generating layer, raising the possibility of failure of the apparatus resulting from dropping broken pieces or injury of the user touching those broken pieces.

On the other hand, the heat insulating elastic layer, which is located closer to the inner circumferential surface than the heat generating layer is, rotates while being pushed at a high pressure by the pressing member to form a nip. Accordingly, the heat insulating elastic layer is susceptible to wear, and may be damaged when used beyond the expected service life. Damage to the heat insulating elastic layer also raises the possibility of failure of the apparatus due to dropping broken pieces. Further, along with the damage to the heat insulating elastic layer, damage is likely to be caused to the surface layer or the sleeve layer located closer to the outer circumferential surface than the heat insulating elastic layer is.

SUMMARY OF THE INVENTION

It is an object of the present invention to at least partially solve the problems in the conventional technology.

According to an aspect of the present invention, a fixing device includes a fixing member, an induction heating unit, a pressing member, and a damage detection unit. The fixing member heats a toner image on a recording medium to fix the toner image onto the recording medium. The induction heating unit heats the fixing member by electromagnetic induction. The pressing member presses the fixing member to form a fixing nip portion. The fixing member includes a heat insulating elastic layer and a sleeve layer. The sleeve layer is located outside the heat insulating elastic layer and is provided with an outer conductive layer that generates heat from a magnetic flux generated by the induction heating unit. The damage detection unit is connected to the outer conductive layer.

According to another aspect of the present invention, an image forming apparatus includes a fixing device including a fixing member, an induction heating unit, a pressing member, and a damage detection unit. The fixing member heats a toner image on a recording medium to fix the toner image onto the recording medium. The induction heating unit heats the fixing member by electromagnetic induction. The pressing member presses the fixing member to form a fixing nip portion. The fixing member includes a heat insulating elastic layer and a sleeve layer. The sleeve layer is located outside the heat insulating elastic layer and is provided with an outer conductive layer that generates heat from a magnetic flux generated by the induction heating unit. The damage detection unit is connected to the outer conductive layer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings. First, with reference to FIG. 1, a description will be given of the configuration and operation of an image forming apparatus according to an embodiment of the present invention.

Figure 1:
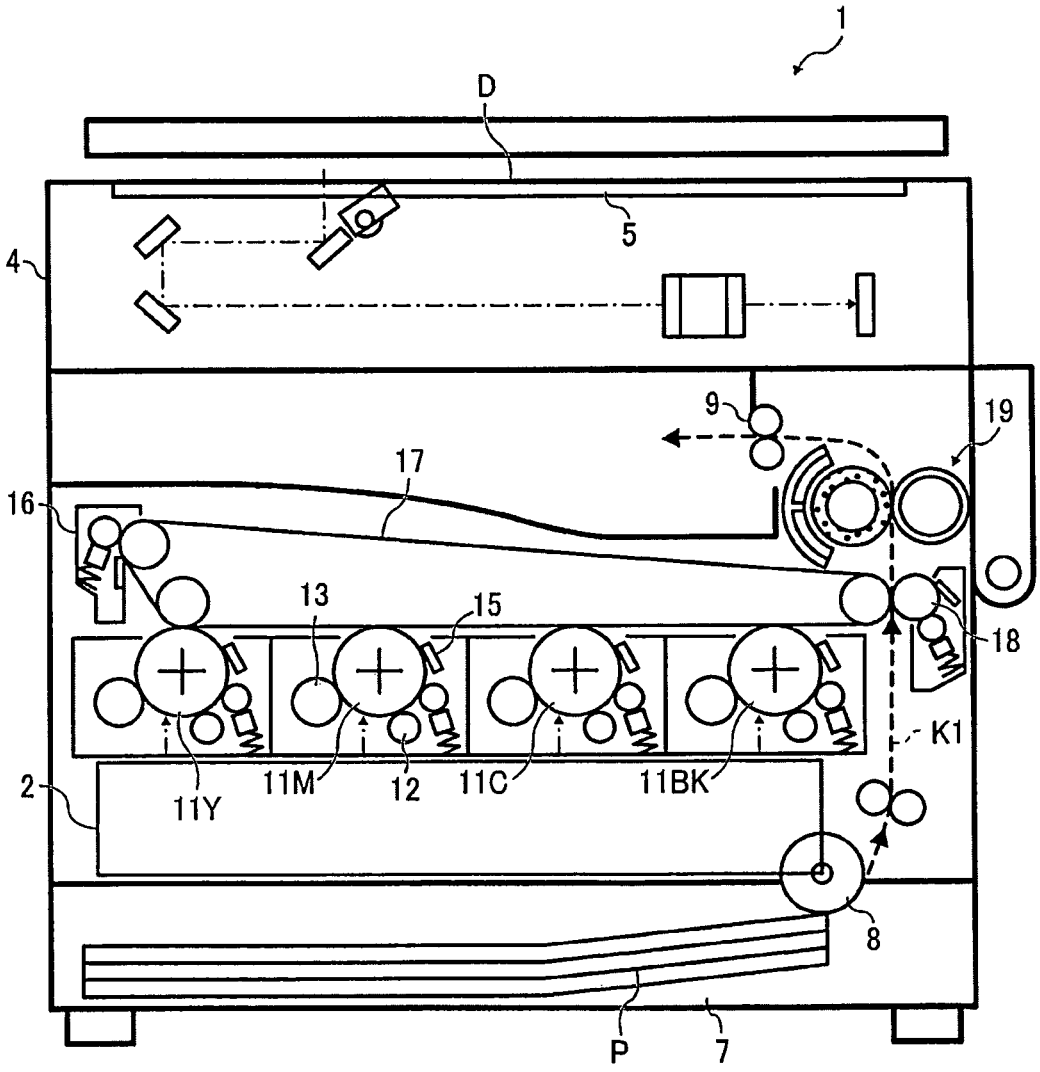
FIG. 1 is a schematic front view of an image forming apparatus according to an embodiment of the present invention.

FIG. 1 illustrates an image forming apparatus 1 according to an embodiment of the present invention. The image forming apparatus 1 will be described by way of example as a tandem color copier. The image forming apparatus 1 includes: a writing unit 2 that emits laser light based on input image information; a reading unit 4 that reads the image information from an original D; a feeding unit 7 that contains a recording medium P such as transfer paper; photosensitive elements 11Y, 11M, 11C, and 11BK on which toner images are formed in different colors (yellow, magenta, cyan, and black), respectively; a charging unit 12 that charges each of the photosensitive elements 11Y, 11M, 11C, and 11BK; a developing unit 13 that develops electrostatic latent images formed on the respective photosensitive elements 11Y, 11M, 11C, and 11BK; and a cleaning unit 15 that collects residual toner on each of the photosensitive elements 11Y, 11M, 11C, and 11BK.

The image forming apparatus 1 further includes: an intermediate transfer belt cleaning unit 16 that cleans an intermediate transfer belt 17; the intermediate transfer belt 17 on which multi-color toner images are transferred in a superimposed manner; a secondary transfer roller 18 that transfers color images formed on the intermediate transfer belt 17 onto the recording medium P; and a fixing device 19 of electromagnetic induction heating type that fixes toner images (unfixed images) on the recording medium P.

A description will be given of the operation of the image forming apparatus 1 to form a color image.

First, the reading unit 4 optically reads image information from the original D placed on an exposure glass 5. More specifically, the reading unit 4 scans an image on the original D placed on the exposure glass 5 while irradiating the original D with the light emitted from the illuminating lamp. Then, the light reflected on the original D is focused on a color sensor via a mirror assembly and lenses. The color image information of the original D is read with respect to each of the RGB color (red, green, blue) separated beams by the color sensor, and then converted into electrical image signals. On the basis of RGB color separated image signals, an image processor converts colors, and compensates colors and space frequencies, thereby obtaining yellow, magenta, cyan, and black color image information. Next, the image information of each yellow, magenta, cyan, and black color is sent to the writing unit 2. The writing unit 2 radiates the photosensitive elements 11Y, 11M, 11C, and 11BK with laser beams (exposure light) corresponding to the respective pieces of the color image information.

The four photosensitive elements 11Y, 11M, 11C, and 11BK each rotates clockwise in FIG. 1. The surfaces of the photosensitive elements 11Y, 11M, 11C, and 11BK are uniformly charged at portions facing the corresponding charging units 12 (the step of charging), respectively. In this manner, an electrostatic charge potential is formed on each of the photosensitive elements 11Y, 11M, 11C, and 11BK. After that, the charged surfaces of the photosensitive elements 11Y, 11M, 11C, and 11BK reach to positions where they are irradiated with laser beams.

In the writing unit 2, four light sources emit laser beams corresponding to the image signals of the respective colors. Each laser beam passes through a separate optical path depending on its color component, i.e., yellow, magenta, cyan, or black (the step of exposure).

The laser beam corresponding to the yellow component is irradiated to the surface of the leftmost photosensitive element 11Y in FIG. 1. At this time, the yellow component laser beam is scanned by a polygon mirror, which rotates at high speeds, in the direction of the rotation axis (in the main-scanning direction) of the photosensitive element 11Y. In this manner, an electrostatic latent image corresponding to the yellow component is formed on the photosensitive element 11Y charged by the charging unit 12.

Likewise, the laser beam corresponding to the magenta component is irradiated to the surface of the second photosensitive element 11M from the left in FIG. 1, thereby forming an electrostatic latent image corresponding to the magenta component. The cyan component laser beam is irradiated to the surface of the third photosensitive element 11C from the left in FIG. 1, thereby forming an electrostatic latent image of the cyan component. The black component laser beam is irradiated to the surface of the fourth photosensitive element 11BK from the left in FIG. 1, thereby forming an electrostatic latent image of the black component.

After that, the surfaces of the photosensitive elements 11Y, 11M, 11C, and 11BK, on each of which the electrostatic latent image is formed in the corresponding color, reach positions facing their respective developing units 13. Then, each of the developing units 13 supplies a toner of corresponding color to each of the photosensitive element 11Y, 11M, 11C, and 11BK to develop the latent image thereon (the step of development).

After the step of development, the portions of the surfaces of the photosensitive elements 11Y, 11M, 11C, and 11BK come to face the intermediate transfer belt 17. The facing portions of the respective photosensitive elements are each provided with a transfer bias roller (not illustrated) to abut against the inner circumferential surface of the intermediate transfer belt 17. At the position of the transfer bias roller, the toner images of the respective colors formed on the photosensitive elements 11Y, 11M, 11C, and 11BK are sequentially transferred onto the intermediate transfer belt 17 in a superimposed manner (the step of primary transfer).

Then, the portions of the surfaces of the photosensitive elements 11Y, 11M, 11C, and 11BK come to face their respective cleaning units 15. The cleaning units 15 collect residual toner remaining on the photosensitive elements 11Y, 11M, 11C, and 11BK (the step of cleaning).

Thereafter, the surfaces of the photosensitive elements 11Y, 11M, 11C, and 11BK pass through corresponding static eliminators (not illustrated), and a series of image forming processes ends on the photosensitive elements 11Y, 11M, 11C, and 11BK.

After that, the intermediate transfer belt 17, on which toner images of respective colors have been transferred in a superimposed manner, reaches a position facing the secondary transfer roller 18. At this position, a secondary transfer backup roller and the secondary transfer roller 18 form a fixing nip portion with the intermediate transfer belt 17 between them. The toner image of the four colors formed on the intermediate transfer belt 17 is transferred onto the recording medium P that has been fed to the position of this fixing nip portion (the step of secondary transfer). At this time, there is residual toner remaining on the intermediate transfer belt 17, which has not been transferred onto the recording medium P.

The intermediate transfer belt 17 then reaches the position of the intermediate transfer belt cleaning unit 16. At this position, the residual toner on the intermediate transfer belt 17 is collected.

In this manner, a series of transfer processes performed on the intermediate transfer belt 17 ends.

The recording medium P is fed to the position of the fixing nip portion from the feeding unit 7 located on the lower side of the main body of the image forming apparatus 1 via a feed path K1 on which a feeding roller 8 and a registration roller are installed. More specifically, the feeding unit 7 stores a stack of a plurality of recording media P. When the feeding roller 8 rotates counterclockwise in the figure, the topmost recording medium P is fed toward the feed path K1.

The recording medium P fed to the feed path K1 is once stopped at the position of the roller nip of the registration roller (not illustrated) that has stopped rotating. In timing synchronized with the color images on the intermediate transfer belt 17, the registration roller is rotationally driven, thereby feeding the recording medium P toward the fixing nip portion. At the fixing nip portion, a desired color image is transferred onto the recording medium P.

The recording medium P onto which the color image has been transferred at the position of the fixing nip portion is fed to the position of the fixing device 19. Then, the recording medium P is subjected to heat and pressure from the fixing roller and the pressing roller at the fixing device 19. Thus, the color image transferred onto the surface is fixed onto the recording medium P (the step of fixing).

After the step of fixing, as indicated by the broken-line arrow, the recording medium P is discharged out of the body of the image forming apparatus 1 with a discharging roller 9 as an output image. The series of image forming processes is thus completed.

Figure 2:
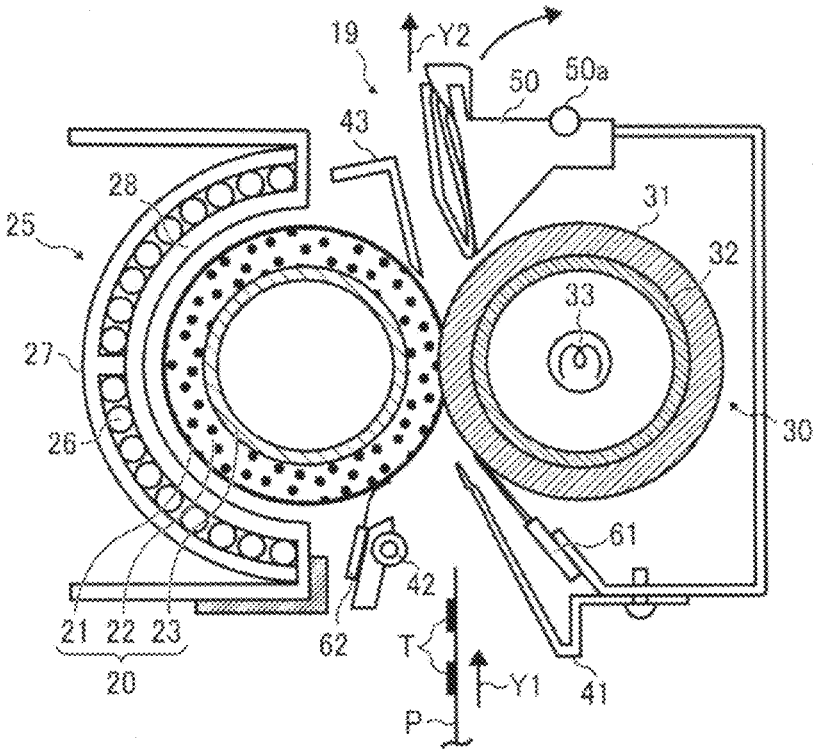
FIG. 2 is a schematic cross-sectional view of a fixing device according to the embodiment.

Referring to FIG. 2, a description will be given in detail of the configuration and operation of the fixing device 19 incorporated in the image forming apparatus 1.

The fixing device 19 includes: an induction heating unit 25 serving as a magnetic flux generating unit; a fixing roller 20 serving as fixing member facing the induction heating unit 25; a pressing roller 30 serving as a pressing member configured to be in pressure contact with the fixing roller 20; an entrance guide plate 41 and a spur guide plate 42 that guide the recording medium P to the fixing nip portion; a separating guide plate 43 that separates the recording medium P from the fixing roller 20; an exit guide plate 50 that guides the recording medium P out of the fixing device 19; and thermistors 61 and 62 that sense the temperature of the fixing roller 20 and the pressing roller 30.

The fixing roller 20 acting as a fixing member includes a metal core 23 of iron or stainless steel, on which a heat insulating elastic layer 22 made of silicone foam rubber and a sleeve layer 21 are deposited in this order from the inner circumferential surface. The fixing roller 20 is formed to have an outer diameter of about 40 mm.

The sleeve layer 21 of the fixing roller 20 has a multi-layered structure in which a substrate layer, a first antioxidant layer, a heat generating layer, a second antioxidant layer, an elastic layer, and a parting layer are sequentially deposited from the inner circumferential surface in that order. More specifically, the substrate layer is formed of stainless steel to be about 40 μm in thickness, while the first antioxidant layer and the second antioxidant layer are formed of strike-plated nickel film in a thickness of about 1 μm or less. The heat generating layer is formed of copper to be about 10 μm in thickness, while the elastic layer is formed of silicone rubber in a thickness of about 150 μm. The parting layer is formed of PFA (tetrafluoroethylene-perfluoroalkyl vinyl ether copolymer) to be about 30 μm in thickness.

The fixing roller 20 structured in this manner is subjected to a magnetic flux produced by the induction heating unit 25 so that the heat generating layer of the sleeve layer 21 is heated by electromagnetic induction. Note that the configuration of the fixing roller 20 is not limited to that of the present embodiment. For example, the sleeve layer 21 can be formed separately without being adhered to the heat insulating elastic layer 22 (the fixing device auxiliary roller). However, a separated sleeve layer 21 (a fixing device sleeve) is preferably provided with a member for preventing the sleeve layer 21 from being shifted in the width direction (in the direction of thrust) during operation.

At a position upstream of the fixing nip portion facing the fixing roller 20 in the feed direction, the spur guide plate 42 is located which has a plurality of spurs located side by side in the width direction. The spur guide plate 42 is located at a position opposite the image-fixed surface of the recording medium P, which is fed into the fixing nip portion, to guide the recording medium P into the fixing nip portion. The periphery of the spurs has a sawtooth shape so that a toner image T or an unfixed image on the recording medium P does not have any scratches thereon even when the spurs of the spur guide plate 42 are brought into contact therewith.

The separating guide plate 43 is located at a position downstream of the fixing nip portion facing the fixing roller 20 in the feed direction and opposite the image-fixed surface of the recording medium P fed from the fixing nip portion. The separating guide plate 43 functions to prevent the recording medium P from adhering to and winding around the fixing roller 20 when having been fed from the fixing nip portion after the step of fixing. That is, after the step of fixing, the recording medium P may adhere to the fixing roller 20 due to the adhesive force of the toner image T. In this case, the separating guide plate 43 is brought into contact with the leading edge of the recording medium P, thereby forcedly separating the recording medium P from the fixing roller 20.

At a position upstream of the fixing nip portion in the feed direction of the recording medium P and proximate to the fixing nip portion, there is located the thermistor 62 serving as a contact temperature sensor in contact with the fixing roller 20. The thermistor 62 is located at an end portion in the width direction on the drive section side to sense the surface temperature of the end portion of the fixing roller 20 in the width direction.

Although not illustrated, a thermopile serving as a noncontact temperature sensor is located at a position opposite the center portion of the fixing roller 20 in the width direction.

The thermistor 62 and the thermopile sense the fixing temperature on the fixing roller 20 to adjust the amount of heat from the induction heating unit 25 based on the sensed results provided by the thermistor 62 and the thermopile. Note that in the present embodiment, the induction heating unit 25 is controlled to realize a fixing temperature of 160 to 165° C. during the step of fixing (when sheets are fed).

The pressing roller 30 serving as the pressing member is formed to have an elastic layer 31 of silicone rubber and the parting layer (not illustrated) of PFA formed on a cylindrical member 32 made of steel or aluminum. The elastic layer 31 of the pressing roller 30 is formed in a thickness of 1 to 5 mm. The parting layer of the pressing roller 30 is formed to be 20 to 200 μm in thickness. The pressing roller 30 is in pressure contact with the fixing roller 20. The pressure contact portion between the fixing roller 20 and the pressing roller 30 forms the fixing nip portion. The recording medium P is fed into the fixing nip portion and subjected to heat and pressure by the fixing roller 20 and the pressing roller 30, thereby allowing the toner image T transferred to the surface to be fixed on the recording medium P.

Note that in the present embodiment, to improve the heating efficiency of the fixing roller 20, the pressing roller 30 is provided therein with a heater 33 such as a halogen heater. The heater 33 is supplied with electric power, thereby allowing the pressing roller 30 to be heated by radiant heat from the heater 33 as well as the surface of the fixing roller 20 to be also heated via the pressing roller 30.

At a position upstream of the fixing nip portion in the feed direction of the recording medium P and proximate to the fixing nip portion, there is located the thermistor 61 serving as a contact temperature sensor in contact with the pressing roller 30. The thermistor 61 is located at an end portion in the width direction on the drive section side to sense the surface temperature of the end portion of the pressing roller 30 in the width direction.

Although not illustrated, a thermopile serving as a noncontact temperature sensor is located at a position opposite the center portion of the pressing roller 30 in the width direction.

Thus, the thermistor 61 and the thermopile are used to sense the temperature on the pressing roller 30 to adjust the amount of heat from the heater 33 on the basis of the sensed results provided by the thermistor 61 and the thermopile.

The entrance guide plate 41 is located at a position upstream of the fixing nip portion facing the pressing roller 30 in the feed direction. This position faces a non-image-fixed surface of the recording medium P fed to the fixing nip portion. The entrance guide plate 41 functions to guide the recording medium P fed to the fixing nip portion to the fixing nip portion.

The exit guide plate 50 is installed at a position downstream of the fixing nip portion facing the pressing roller 30 in the feed direction. This position faces a non-image-fixed surface of the recording medium P sent out of the fixing nip portion. The exit guide plate 50 serves to guide the recording medium P, which has been sent out of the fixing nip portion after the step of fixing, toward the feed path taken for the subsequent step. The exit guide plate 50 can be opened by being rotated about a rotation shaft 50*a* in the direction indicated by the arrow in the figure, and thus allows to remove the recording medium P, for example, when it is caught in the fixing nip portion.

The induction heating unit 25 includes a coil portion 26 serving as an excitation coil, a core portion 27 serving as an excitation coil core, and a coil guide 28 facing the fixing member to hold the coil portion 26. The coil portion 26 is structured such that Litz wires of bundles of thin wires are wound around the coil guide 28, which is located to cover part of the outer circumferential surface of the fixing roller 20, and extended in the width direction (in the direction perpendicular to the plane of FIG. 2).

The coil guide 28, which is made of a highly heat-resistant resin material such as PET (polyethylene terephthalate) containing about 45% of glass material, holds the coil portion 26 as facing the outer circumferential surface of the fixing roller 20. Note that, in the present embodiment, sets a gap is set to 2±0.1 mm between the opposing surface of the coil guide 28 of the induction heating unit 25 and the outer circumferential surface of the fixing roller 20.

The core portion 27, which is made of a ferromagnetic substance such as ferrite which has a relative permeability of about 2500, serves to efficiently form a magnetic flux for the heat generating layer in the sleeve layer 21 of the fixing roller 20. The core portion 27 mainly includes an arch core, a center core, and a side core.

In the present embodiment, the induction heating unit 25 is located along the side of the fixing roller 20.

The fixing device 19 configured in this manner operates as follows.

The fixing roller 20 is driven by a drive motor (not illustrated) to rotate counterclockwise in FIG. 2, followed by the clockwise rotation of the pressing roller 30. Then, at a position opposite the induction heating unit 25, the heat generating layer in the sleeve layer 21 of the fixing roller 20 is heated with a magnetic flux generated by the induction heating unit 25.

More specifically, the coil portion 26 is supplied with a high-frequency alternating current at 10 kHz to 1 MHz (preferably, 20 kHz to 800 kHz) from a frequency-variable power supply unit (not illustrated) having an oscillator circuit. This allows the coil portion 26 to form alternating magnetic lines of force toward the sleeve layer 21 of the fixing roller 20. Such an alternating magnetic field formed in this manner produces an eddy current on the heat generating layer of the sleeve layer 21, and its electrical resistance causes Joule heat to be generated. The heat generating layer is thus heated by induction. In this manner, the sleeve layer 21 of the fixing roller 20 is heated by its own heat generating layer being heated by induction.

After that, the surface of the fixing roller 20 heated by the induction heating unit 25 reaches the fixing nip portion that is the contact portion with the pressing roller 30. Then, the toner image T on the recording medium P being fed is heated, melted, and fixed onto the recording medium P.

More specifically, the recording medium P carrying the toner image T after the image forming process described earlier is fed in the feed direction indicated by arrow Y1 into the fixing nip portion between the fixing roller 20 and the pressing roller 30 while being guided by the entrance guide plate 41 or the spur guide plate 42. Then, the heat received from the fixing roller 20 and the pressure received from the pressing roller 30 cause the toner image T to be fixed onto the recording medium P. The recording medium P is fed from between the fixing roller 20 and the pressing roller 30 in the feed direction indicated by arrow Y2.

The surface of the fixing roller 20 having passed through the fixing nip portion subsequently reaches a position facing the induction heating unit 25 again.

Such a series of operations are continuously repeated, and thereby the fixing step is completed in the image forming process.

In the present embodiment, the fixing device is heated by electromagnetic induction. However, the fixing device of the present invention is not limited to this embodiment. The fixing device may also employ as a heat source only a halogen heater provided in the fixing roller, or may be a belt fixing device that employs a conventionally suggested endless belt.

A description will be given of the salient features of several embodiments of the present invention.

Figure 3:
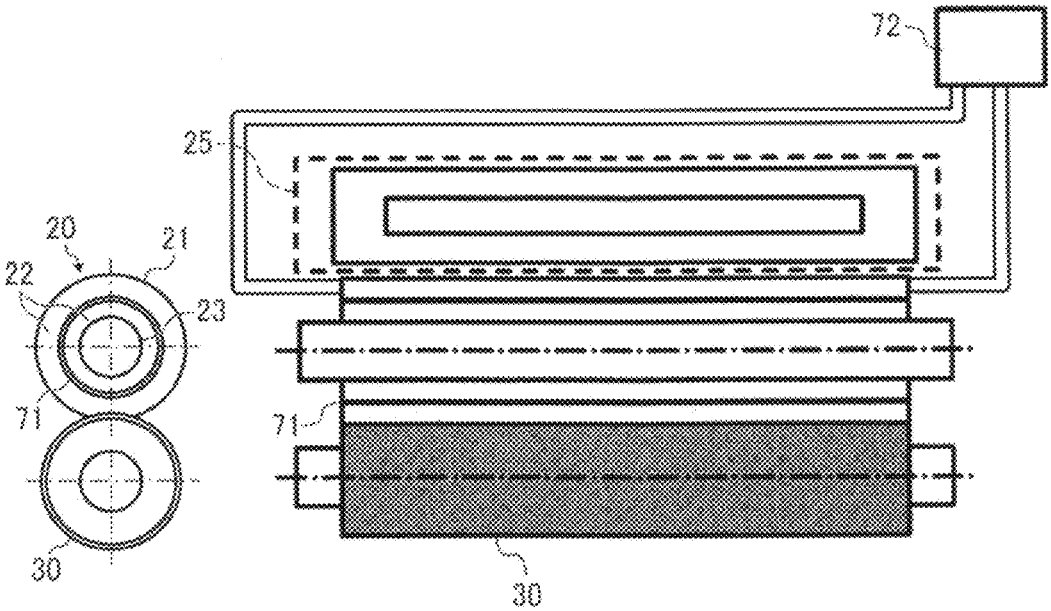
FIG. 3 is a schematic cross-sectional view of a fixing device according to a first embodiment of the present invention.

FIG. 3 illustrates a fixing device according to a first embodiment of the present invention.

The heat insulating elastic layer 22 of the fixing roller 20 is formed on the metal core 23, and the sleeve layer 21 is formed on the heat insulating elastic layer 22 so that the sleeve layer 21 rotates along with the heat insulating elastic layer 22. In the present embodiment, the heat insulating elastic layer portion has a three-layered structure which includes the heat insulating elastic layer 22, an electrically conductive member 71, and the heat insulating elastic layer 22 arranged in that order from the inner circumferential surface. The electrically conductive member 71 is a flat member made of, for example, a thin copper film of about 10 μm in thickness. This member is securely adhered with a silicone adhesive or the like in between the heat insulating elastic layers such as of silicone foam rubber, and formed in a cylindrical shape. The thin copper film is flexible and surrounded by the elastic layer, thus having no effects on the formation of the fixing nip portion. As illustrated, the fixing roller 20 is deformed when pressed by the pressing roller 30, thus causing the fixing nip portion to be formed in a manner such that the pressing roller 30 is engaged with the fixing roller 20.

The fixing roller 20 being pressed by the pressing roller 30 and thereby deformed deteriorates with time, resulting in the cylindrical sleeve layer 21 being wrinkled or cracked. In particular, the sleeve layer 21 may be cracked circumferentially at a certain point along the roller axis, causing the sleeve layer 21 to be split into two. In this case, the surface of the fixing roller 20 has been significantly damaged and thus the fixation for assuring a high quality image is not realized. Accordingly, in such a case, the damage to the sleeve layer 21 needs to be detected as early as possible and actions have to be immediately taken, for example, by stopping printing operations or replacing the fixing roller 20.

Furthermore, not only the sleeve layer 21 is damaged but also the heat insulating elastic layer 22 may be damaged which is located closer to the inner circumferential surface than the sleeve layer 21 is. This is because the heat insulating elastic layer 22 is susceptible to wear while being pressed by the pressing roller 30 with high pressure to form the fixing nip portion. At this time, like damage to the sleeve layer 21, damage to the heat insulating elastic layer 22 also raises the possibility of causing apparatus failure due to dropped broken pieces of the heat insulating elastic layer 22. Furthermore, when the heat insulating elastic layer 22 located closer to the inner circumferential side is damaged, a failure of the sleeve layer 21 located closer to the outer circumferential surface side can be estimated with high reliability. It is therefore necessary to detect damage to these sleeve layers 21 and heat insulating elastic layer 22 as soon as possible.

In this context, the present embodiment is configured to connect a resistance detection circuit 72 to either or both the sleeve layer 21 of the fixing roller 20 and the electrically conductive member 71. In particular, the sleeve layer 21 may be preferably provided with the resistance detection circuit 72 connected to the heat generating layer that may be readily damaged from thermal runaway due to overheating. On the other hand, unlike this arrangement, the resistance detection circuit 72 may also be connected to either one or both of the substrate layer and the first antioxidant layer on the inner circumferential surface side. This is because damage to these layers on the inner circumferential surface side allows one to readily expect the presence of damage to the heat generating layer that is located on the outer circumferential surface side. Furthermore, detecting the damage with the resistance detection circuit 72 connected to the electrically conductive member 71 makes it possible to detect damage to the heat insulating elastic layer 22 that is located on the outer circumferential surface side. It is thus possible to detect at an early stage such significant damage to the fixing roller 20 that has detrimental effects on the fixing step.

With the resistance detection circuit 72 connected to the heat generating layer of the cylindrical sleeve layer 21, it is possible to observe a current I flowing through the circuit while a constant voltage V is applied to the circuit. The resistance value R can be determined based on the relationship R=V/I. In the absence of damage, the heat generating layer has a resistance value R of, for example, 1.5Ω. However, when the roller is damaged over about a ⅕ of the entire width of the roller from both the ends of the roller toward the center, the heat generating layer has an increase of 0.1Ω in resistance value R.

Likewise, with the resistance detection circuit 72 connected to the cylindrical electrically conductive member 71, the electrically conductive member 71 has a resistance value R of, for example, 1.5Ω. However, when the roller is damaged over about a ⅕ of the entire width of the roller from both the ends of the roller toward the center, the heat generating layer has an increase of 0.1Ω in resistance value R.

Accordingly, a detected resistance value R of 1.7Ω or greater can be set as a damage detection condition to detect a significant damage to the fixing roller 20 with high reliability. Upon detection of such a damage, a message "Fixing device Abnormal" can be indicated on the operation panel of the main body of the image forming apparatus or on the monitor display of a personal computer. At the same time, the printing operation can be stopped and the fixing roller 20 can be replaced. This can prevent apparatus failure due to broken pieces being dropped as a result of damage progression or troubles such as injury of the user caused by touching broken pieces. As a matter of course, it is also possible to set, as a damage detection condition, a resistance value R of 1.6Ω or greater which is associated with damage to either the sleeve layer 21 or the electrically conductive member 71.

When the sleeve layer 21 has been split into two due to circumferential cracks at a certain point on the sleeve layer 21 along the roller axis, then I becomes 0 and the resistance value R is abruptly increased so as not to be detected. In any case, setting a resistance value R of 1.6 Ω or 1.7Ω or greater as the damage detection condition allows for coping with such a significant damage to the sleeve layer 21.

Note that the cylindrical electrically conductive member 71 may be replaced with a coil so that the heat insulating elastic layer portion has a three-layered structure of the heat insulating elastic layer 22, the coil, and the heat insulating elastic layer 22. More specifically, one piece of wire such as of copper wire is inserted from one end of the fixing roller 20, wound in a spiral around the roller axis, and then taken out of the other end of the fixing roller 20. Then, the resistance detection circuit 72 is connected to both the ends of the wire to detect its resistance value R. The wire may be deteriorated, as the fixing roller 20 degrades, and broken at a certain point, thus being split into two. In this case, the resistance value R is abruptly increased so as not to be detected. At this time, the heat insulating elastic layer 22 and the sleeve layer 21, which are located closer to the outer circumferential surface side than the wire is, are thought to have been damaged. Accordingly, the message "Fixing device Abnormal" can be indicated on the operation panel of the main body of the image forming apparatus or on the monitor display of a personal computer. At the same time, the printing operation can be stopped and the fixing roller 20 can be replaced.

The electrically conductive member 71 or a coil may be located near the metal core 23 where the member 71 or the coil is less prone to being pressurized by the pressing roller 30; however, they may be preferably located near the sleeve layer 21. This is because in the former case, the electrically conductive member 71 or the coil is not damaged even when the sleeve layer 21 and the heat insulating elastic layer 22 in its vicinity have been damaged. This leads to no variation in resistance value R, and thus the damage to the sleeve layer 21 and the heat insulating elastic layer 22 may not be detected. On the other hand, to sense the resistance value R of the electrically conductive member 71 or the coil with accuracy, they needs to be located not in direct contact with the sleeve layer 21, and preferably, a heat insulating elastic layer of an adequate thickness is provided between them and the sleeve layer 21.

The resistance detection circuit 72 may be secured to one side about the axis of the fixing roller 20, thereby being rotated along with the rotary motion of the fixing roller 20. Furthermore, the metal core 23 may be made hollow to pass a wire from the resistance detection circuit 72 therethrough, thereby allowing the wire to extend to the other end. This arrangement allows the resistance detection circuit 72 and its wiring to rotate only within the range of the fixing roller 20, having no effects on the formation of the fixing nip portion.

Figure 4:
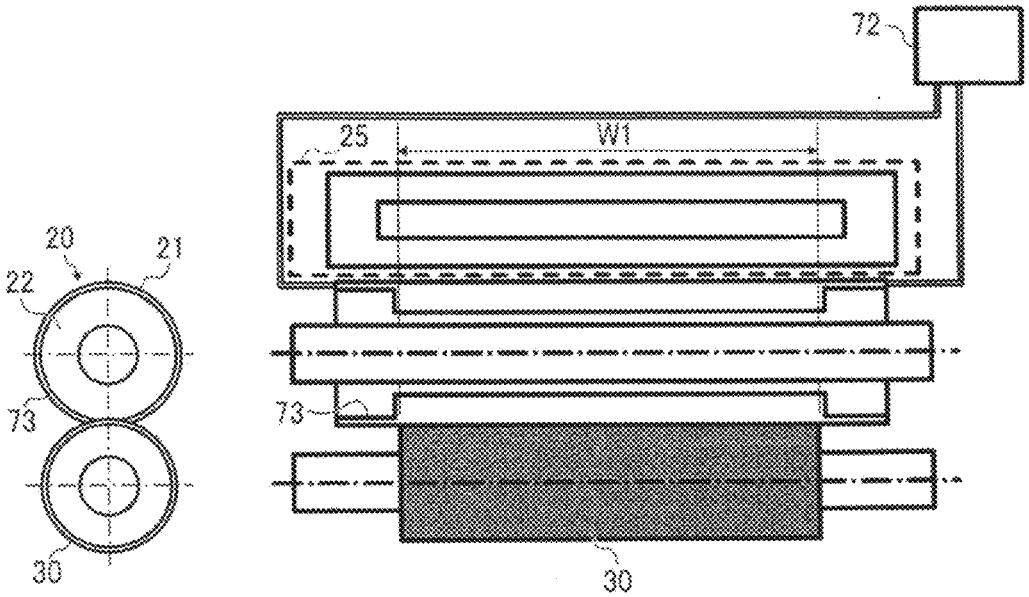
FIG. 4 is a schematic cross-sectional view of a fixing device according to a second embodiment of the present invention.

FIG. 4 illustrates a fixing device according to a second embodiment of the present invention. A description will be given mainly of the difference from the first embodiment.

The fixing roller 20 is structured such that the heat insulating elastic layer 22 and the sleeve layer 21 are formed in this order on the metal core 23, allowing the sleeve layer 21 to rotate along with the heat insulating elastic layer 22. In the present embodiment, the heat insulating elastic layer portion includes three layers, i.e., the heat insulating elastic layer 22, an electrically conductive member 73, and the heat insulating elastic layer 22 in this order from the inner circumferential surface side. As in the first embodiment, for example, the electrically conductive member 73 is a flat member made of a thin copper film about 10 μm in thickness. This member is securely adhered with a silicone adhesive or the like in between the heat insulating elastic layers such as of silicone foam rubber, and formed in a cylindrical shape. Furthermore, the resistance detection circuit 72 is connected to either or both the sleeve layer 21 of the fixing roller 20 and the electrically conductive member 73.

Incidentally, some fixing devices are provided at the ends of the fixing roller 20 with an inhibit member in contact with the sleeve layer 21. The inhibit member prevents the sleeve layer 21 from being shifted in the directions of width (thrust) and the roller axis. In this case, the contact with the inhibit member makes the ends susceptible to wear.

Thus, in the present embodiment, the electrically conductive member 73 formed in a cylindrical shape is located outside the range of a maximum sheet feed width W1 and near the sleeve layer 21 at the ends of the fixing roller 20. Additionally, the member 73 extending toward the inner circumferential surface within the maximum sheet feed width W1 is located near the metal core 23 and spaced apart from the sleeve layer 21 within the range of the maximum sheet feed width W1. Also, the pressing roller 30 that forms the fixing nip portion in conjunction with the fixing roller 20 is located within the range of the maximum sheet feed width W1. This arrangement allows the electrically conductive member 73 within the range of the maximum sheet feed width W1 to receive almost no pressure from the pressing roller 30, thus having no effects on the formation of the fixing nip portion. Thus, the flexibility of the fixing roller 20 required to form the fixing nip portion can be ensured, and the electrically conductive member 73 within the range of the maximum sheet feed width W1 is normally not damaged.

Besides, the ends of the fixing roller 20 outside the range of the maximum sheet feed width W1 are susceptible to wear and damage due to aging. Therefore, when cracks are found at this portion in the circumferential direction and the electrically conductive member 73 is split into two, the damage can be sensed from an increase in the resistance value R. According to the present embodiment, at the ends of the fixing roller 20 where damage can readily occur to the sleeve layer 21 and the heat insulating elastic layer 22, the electrically conductive member 73 can be added to detect damage without degrading the thermal insulation of the fixing roller in the sheet feed area and reducing the flexibility required to form the fixing nip portion.

As in the first embodiment, the resistance value R of the electrically conductive member 73 with no damage found can be determined to set a predetermined resistance value as a damage detection condition. When the resistance detection circuit 72 has sensed a predetermined resistance value or greater, it is possible to determine that damage has occurred to either the sleeve layer 21 or the heat insulating elastic layer 22, which is located closer to the outer circumferential surface side. Then, the message "Fixing device Abnormal" can be indicated on the operation panel of the main body of the image forming apparatus or on the monitor display of the personal computer. At the same time, the printing operation can be stopped and the fixing roller 20 can be replaced. This can prevent apparatus failure due to broken pieces being dropped as a result of damage progression or troubles such as injury of the user caused by touching broken pieces.

Note that the cylindrical electrically conductive member 73 may be replaced with a coil so that the heat insulating elastic layer portion has a three-layered structure of the heat insulating elastic layer 22, the coil, and the heat insulating elastic layer 22. More specifically, one piece of wire such as of copper wire is inserted from one end of the fixing roller 20, wound in a spiral around the roller axis, and, then taken out of the other end of the fixing roller 20. At this time, the wire may be located near the sleeve layer 21 at the ends of the fixing roller 20 outside the range of the maximum sheet feed width W1. The wire then may be extended toward the inner circumferential surface within the maximum sheet feed width W1 so that it is located near the metal core 23 within the range of the maximum sheet feed width W1. Then, the resistance detection circuit 72 is connected to both the ends of the wire to detect the resistance value R. The wire may be deteriorated, as the fixing roller 20 degrades, and broken at a certain point, thus being split into two. In this case, the resistance value R is abruptly increased so as not to be detected. Accordingly, at this time, it can be determined that damage has also occurred to either the heat insulating elastic layer 22 or the sleeve layer 21, which is located closer to the outer circumferential surface side than the wire is.

Figure 5:
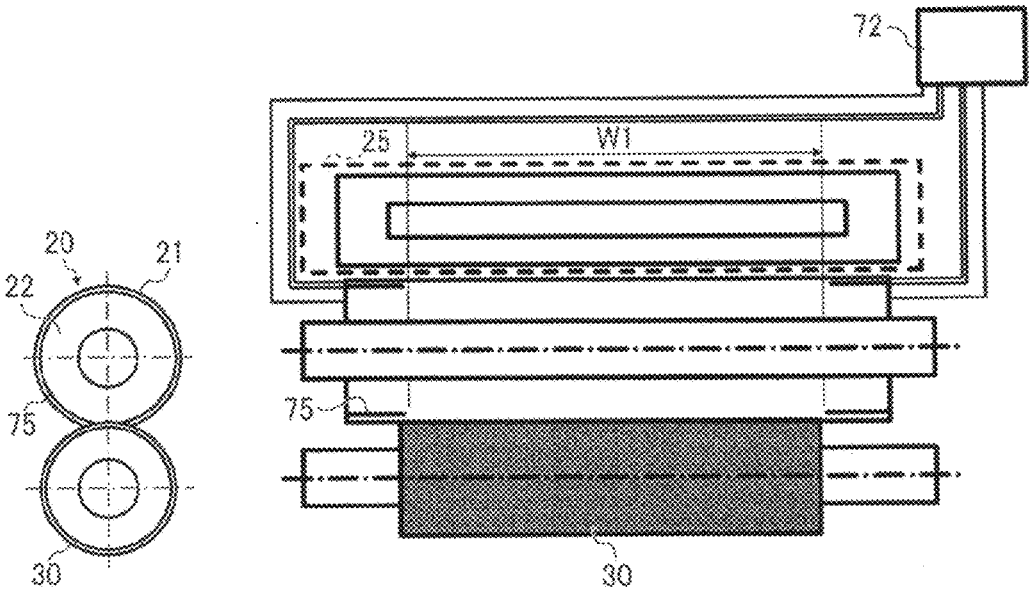
FIG. 5 is a schematic cross-sectional view illustrating a fixing device according to a third embodiment of the present invention.

FIG. 5 illustrates a fixing device according to a third embodiment of the present invention. A description will be given mainly of the difference from the first and second embodiments.

The fixing roller 20 is structured such that the heat insulating elastic layer 22 and the sleeve layer 21 are formed in this order on the metal core 23, allowing the sleeve layer 21 to rotate along with the heat insulating elastic layer 22. In the present embodiment, at two points of the end portions of the fixing roller 20 outside the range of the maximum sheet feed width W1, the heat insulating elastic layer portion includes three layers, i.e., the heat insulating elastic layer 22, an electrically conductive member 75, and the heat insulating elastic layer 22 in this order from the inner circumferential surface side. The electrically conductive member 75 is a flat member made of, for example, a thin copper film of about 10 μm in thickness. This member is securely adhered with a silicone adhesive or the like in between the heat insulating elastic layers such as of silicone foam rubber, and formed in a cylindrical shape.

In the present embodiment, the electrically conductive member 75 at the ends is generally cylindrical in shape. More specifically, the electrically conductive member 75 extends, for example, over the range of 340 degrees around the center of the roller axis, with the two ends of the electrically conductive member 75 spaced apart from each other. The resistance detection circuit 72 is connected to one end and the other end of the electrically conductive member 75. Accordingly, when the electrically conductive member 75 has been split into two due to cracks along the roller axis, then I becomes 0 and the resistance value R is abruptly increased, thereby enabling the detection of the damage to the electrically conductive member 75. Furthermore, the resistance detection circuit 72 may also be connected to the sleeve layer 21 of the fixing roller 20, thereby allowing for detecting damage to the sleeve layer 21 on the basis of a change in the resistance value R of the sleeve layer 21. Furthermore, the pressing roller 30 that forms the fixing nip portion along with the fixing roller 20 is located within the range of the maximum sheet feed width W1, thus causing the pressure from the pressing roller 30 to have no effects on the electrically conductive member 75.

Therefore, in the present embodiment, at the ends of the fixing roller 20 where damage can readily occur to the sleeve layer 21 and the heat insulating elastic layer 22, the electrically conductive member 75 can be added to detect damage without degrading the thermal insulation of the fixing roller in the sheet feed area and reducing the flexibility required to form the fixing nip portion.

Note that the electrically conductive member 75 generally cylindrical in shape may be replaced with a coil so that at the two ends of the fixing roller 20 outside the range of the maximum sheet feed width W1, the heat insulating elastic layer portion has a three-layered structure of the heat insulating elastic layer 22, the coil, and the heat insulating elastic layer 22. More specifically, one piece of wire such as of copper wire is inserted from one end of the fixing roller 20. The wire extends into depth along an outgoing path while being wound in a spiral around the roller axis. Then, the wire returns to follow the same route as the outgoing path and comes out of the other end of the fixing roller 20. This arrangement can avoid the wire from overlapping. Then, the resistance detection circuit 72 is connected to both the ends of the wire to detect its resistance value R. The wire may be deteriorated, as the fixing roller 20 degrades, and broken at a certain point, thus being split into two. In this case, the resistance value R is abruptly increased so as not to be detected. Accordingly, at this time, it can be determined that damage has also occurred to either the heat insulating elastic layer 22 or the sleeve layer 21, which is located closer to the outer circumferential surface side than the wire is.

According to an embodiment of the present invention, the electrically conductive layer of the sleeve layer is connected with the damage detection unit. This allows for early detection of damage to the sleeve layer, thereby making it possible to prevent failure of the apparatus due to dropping broken pieces or injury of the user touching those broken pieces. Thus, upon detection of damage, quick actions can be taken, for example, by stopping printing operation or replacing the fixing roller. Moreover, the inner conductive layer is provided in the heat insulating elastic layer, and the damage detection unit is also connected to the inner conductive layer. This allows for early detection of damage to the heat insulating elastic layer located outside the inner conductive layer.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device, comprising:

a fixing member that heats a toner image on a recording medium to fix the toner image onto the recording medium;

an induction heating unit that heats the fixing member by electromagnetic induction; and a pressing member that presses the fixing member to form a fixing nip portion, wherein the fixing member includes a heat insulating elastic layer and a sleeve layer, the sleeve layer being located outside the heat insulating elastic layer and provided with an outer conductive layer that generates heat from a magnetic flux generated by the induction heating unit, and the fixing device further includes a damage detection unit that is connected to the outer conductive layer to detect a change in electric resistance of the outer conductive layer for detecting damage to the fixing member, and the fixing device changes a condition of conveyance of the recording medium to the fixing nip portion if the damage detecting unit detects damage to the fixing member.

2. The fixing device according to claim 1, further comprising an inner conductive layer in the heat insulating elastic layer, wherein the damage detection unit is also connected to the inner conductive layer.

3. The fixing device according to claim 2, wherein the inner conductive layer is formed of a flat member in a cylindrical shape or in substantially a cylindrical shape.

4. The fixing device according to claim 2, wherein the inner conductive layer includes a piece of wire wound in a spiral.

5. The fixing device according to claim 2, wherein the inner conductive layer is located near the sleeve layer.

6. The fixing device according to claim 2, wherein the inner conductive layer is located near the sleeve layer.

7. The fixing device according to claim 2, wherein the inner conductive layer is located near the sleeve layer outside a range of a maximum feed width of the recording medium and spaced apart from the sleeve layer within the range of the maximum feed width.

8. The fixing device according to claim 2, wherein the inner conductive layer is located near the sleeve layer outside a range of a maximum feed width of the recording medium and spaced apart from the sleeve layer within the range of the maximum feed width.

9. The fixing device according to claim 2, wherein the inner conductive layer is located at two portions on both ends of the fixing member outside a range of a maximum feed width of the recording medium.

10. The fixing device according to claim 2, wherein the inner conductive layer is located at two portions on both ends of the fixing member outside a range of a maximum feed width of the recording medium.

11. The fixing device according to claim 1, wherein the damage detection unit is a resistance detection circuit.

12. The fixing device according to claim 1, wherein the pressing member is located within a range of a maximum feed width of the recording medium.

13. An image forming apparatus including a fixing device, the image forming apparatus comprising:

a fixing member that heats a toner image on a recording medium to fix the toner image onto the recording medium;

an induction heating unit that heats the fixing member by electromagnetic induction; and a pressing member that presses the fixing member to form a fixing nip portion, wherein the fixing member includes a heat insulating elastic layer and a sleeve layer, the sleeve layer being located outside the heat insulating elastic layer and provided with an outer conductive layer that generates heat from a magnetic flux generated by the induction heating unit, and the fixing device further includes a damage detection unit that is connected to the outer conductive layer to detect a change in electric resistance of the outer conductive layer for detecting damage to the fixing member, and the fixing device changes a condition of conveyance of the recording medium to the fixing nip portion if the damage detecting unit detects damage to the fixing member.

* * * * *